United States Patent [19]

Riches

[11] Patent Number: 4,889,497

[45] Date of Patent: Dec. 26, 1989

[54] SHIELDED ELECTRICAL CONNECTOR

[75] Inventor: Arthur J. Riches, Kent, England

[73] Assignee: Amphenol Corporation, Wallingford, Conn.

[21] Appl. No.: 234,923

[22] Filed: Aug. 22, 1988

[30] Foreign Application Priority Data

Aug. 28, 1987 [GB] United Kingdom ..... 8720369

[51] Int. Cl.[4] ..... H01R 13/648; H01R 13/66

[52] U.S. Cl. ..... 439/76; 439/610; 439/620; 439/95

[58] Field of Search ..... 439/620, 76, 607, 610, 439/98, 108, 92, 95; 333/181–185; 361/111, 119

[56] References Cited

U.S. PATENT DOCUMENTS

| | | | |
|---|---|---|---|
| 3,258,649 | 6/1966 | Arguin et al. | 439/76 |
| 4,723,196 | 2/1988 | Hofmeister et al. | 439/76 |
| 4,731,031 | 3/1988 | Lemke | 439/76 |
| 4,786,257 | 11/1988 | Tengler | 439/76 |

FOREIGN PATENT DOCUMENTS 2193390 2/1988 United Kingdom .

*Primary Examiner*—Gary F. Paumen

*Attorney, Agent, or Firm*—Bacon & Thomas

[57] ABSTRACT

A shielded electrical connector includes a housing arranged to receive a shielded cable, a connector for connecting the cable shield to the connector housing, a connector element located in the housing with contacts connected to tracks on a printed circuit board within the housing, a ground plane spaced from the printed circuit board and electrically connected to the connector housing and a plurality of surge arrestors located between respective tracks on the printed circuit board and the ground plane. A resiliently flexible member may be located between the connector housing and the ground plane for making an electrical connection between the housing and the ground plane.

12 Claims, 3 Drawing Sheets

SHIELDED ELECTRICAL CONNECTOR

BACKGROUND OF THE INVENTION

This invention relates to screened electrical connectors fitted with surge arrestors.

Multi-contact electrical connectors are well known for making electrical connections between items of communication, control or computer systems via multicore cables. One such connector is described in British Patent Application No. 2,193,390. Typically connections are made by a cable carrying a plug-in, male or female, connector at each end which mates with a complementary connector attached to an outer surface of an equipment case. The types of equipment these connections are used for are often susceptible to damage caused by surge voltages induced by lightning strikes and various electrical fault conditions. The connector described in the above-mentioned application makes no provision for surge protection.

SUMMARY OF THE INVENTION

The invention provides a shielded electrical connector including a conductive connector housing to receive a shielded cable, means to connect the cable shield to the connector housing, a connector element located in the housing and having contacts connected to respective tracks on a printed circuit board within the housing, a ground plane spaced from the printed circuit board and electrically connected to the connector housing, and a plurality of surge arresters located between respective tracks on the printed circuit board and the ground plane.

BRIEF DESCRIPTION OF THE DRAWINGS

The invention will now be described in more detail by way of example with reference to the drawings in which.

DETAILED DESCRIPTION OF THE PREFERRED EMBODIMENT

Figure 1:
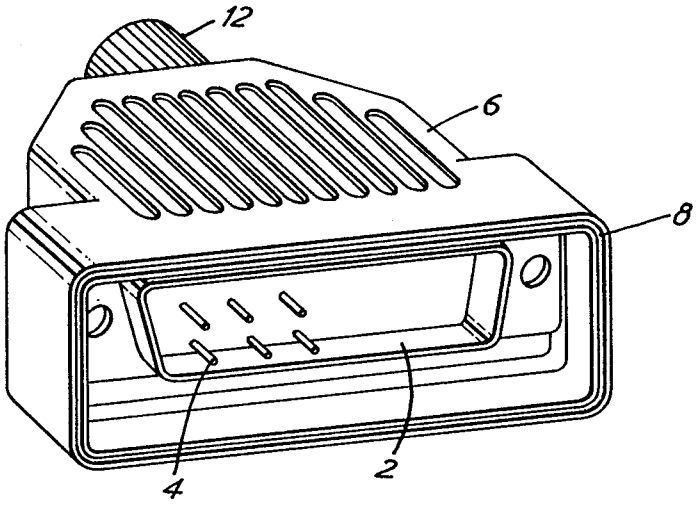
FIG. 1 is a perspective view of a screened electrical connector assembly.
Figure 3:
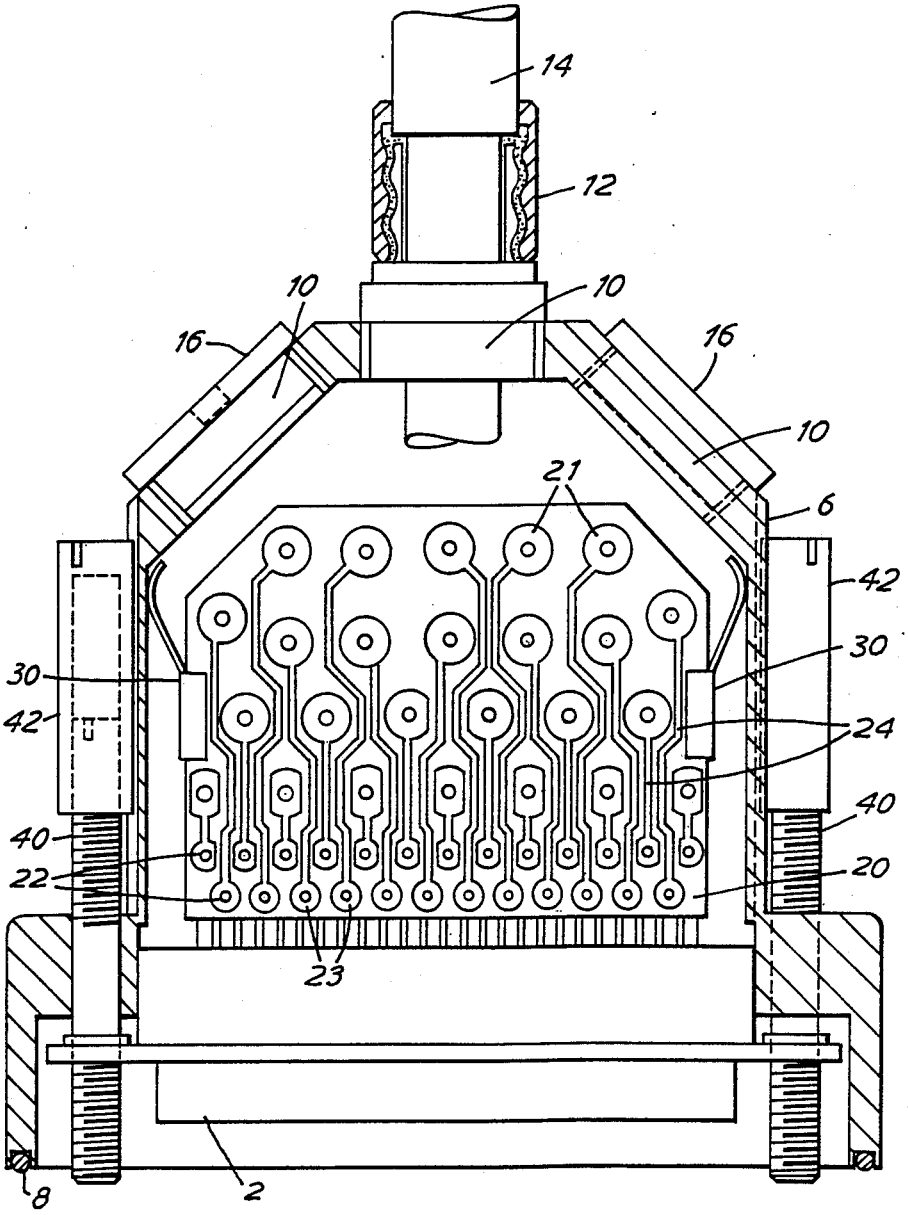
FIG. 3 is a plan section of the assembly of FIG. 1.

The perspective view of FIG. 1 shows a shielded electrical connector assembly. This comprises a D-type connector element 2 with two rows of electrical contacts 4 which in this example are pins (although the connector element 2 is female). The connector element 2 fits into the open end of a conductive connector housing 6 which is of one piece construction, i.e., constructed from a single piece of material to provide good EMI screening. Around the open end is an elastomeric conductive seal 8 to make up any uneveness of fit between the housing and a co-operating connector in a second housing or in a metal panel. At the opposite end of the housing as shown in FIG. 3 are three alternative cable entries 10 which are used depending on the wiring application (direct entry or daisy-chain). For the selected entry, a strain relieving braid trap 12 is fitted to receive an incoming cable 14 and to connect its braid screen to the housing. Metal blanking plugs 16 are fitted to the unused entries.

Figure 2:
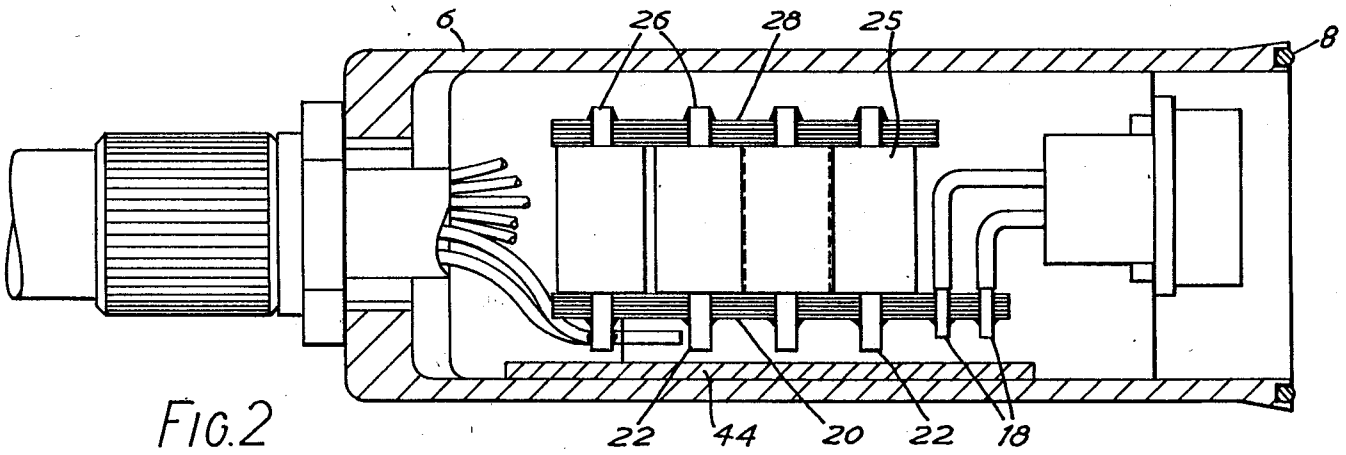
FIG. 2 is a side section of the assembly of FIG. 1.

In FIGS. 2 and 3, the internal construction of the connector is shown. The electrical contacts 4 in the connector element are respectively connected through to PCB edge-mounting contacts 18. These are soldered into position with pads 21 around co-operating holes 22 on a PCB 20.

On the PCB are tracks 24 which connect the pads 21 to pads 23 around respective holes in which the terminating posts 22 of respective surge arrestors 24 are located. The terminating posts 26 at the opposite ends of the surge arrestors 24 locate in respective holes in a ground plane 28 parallel to the PCB 20.

Figure 4:
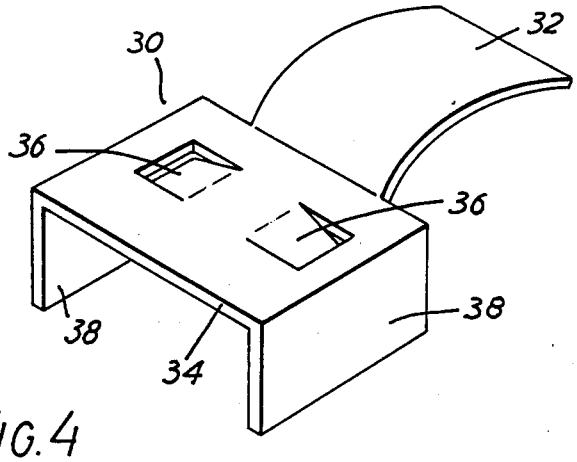
FIG. 4 is a perspective view of an earthing spring.
Figure 5:
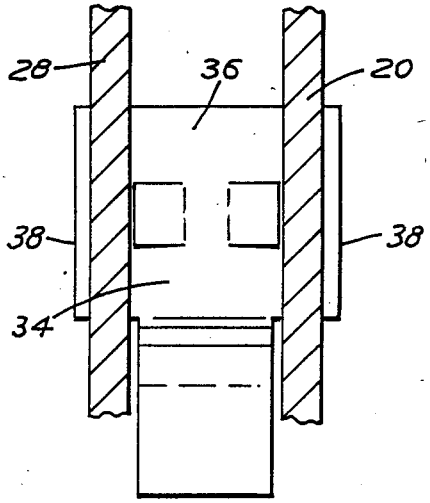
FIG. 5 is a view of the spring retaining a printed circuit board and a ground plane board.

Prior to soldering, the PCB 20 and ground plane 28 are held together by two earthing springs 30 preferably made from a copper alloy (illustrated in FIG. 4). These springs are also used to connect the ground plane 28 to the connector housing 6 via an arcuate spring 32. Each earthing spring comprises a section of three sided rectangular channel. The middle side 34 of this channel has two protruding lugs 36 each close to the respective side wall 38 of the channel. These are cut and bent from the middle wall 34, thus defining respective spaces to receive the PCB and the ground plane. The arcuate spring 32 extends from the middle wall 34 of the channel and protrudes in the opposite direction to the lugs 36 and sidewalls 38.

With the PCB and the ground plane held together by the springs 30, the surge arrestors are soldered to the earth plane and to the PCB. The springs are also soldered to the ground plane and preferably to an earth connection (not shown) on the PCB. This ensures a good earth connection to the ground plane. When the PCB and earth plane are located inside the connector housing 6, the arcuate springs 32 make contact with the metallic housing, thereby electrically connecting the earth plane to the housing.

Two screws are provided on either side of the housing. The inner screws 40 secure the connector element 2 to a co-operating connector element (not illustrated). The outer screws 42 secure the connector housing 6 to the connector element 2 once the housing is in plane, by screwing onto the co-operating ends of the inner screws 40.

To assemble the connector, the outer screws 42 are removed and the connector/PCB assembly withdrawn from the connector housing 6. The braid trap 12 is fitted to the selected entry 10 to the housing and the housing is slid up the screened cable.

The cable 14 has its braid screen trimmed to the appropriate length and each of the internal conductors is also trimmed to the appropriate length. The conductors are soldered directly onto the terminating posts 22 of the surge arrestors 24 which protrude through the PCB 20. Thus any induced high surge voltage will be shunted through the surge arrestors to the ground plane before reaching the PCB, thus preventing damage to the board, connector or equipment.

After terminating the incoming cable, the assembly is mated to a co-operating connector and secured thereto by the inner screws 40. The connector housing 6 is then slid forward over the assembly, the earthing springs 30 engaging against the inner walls of the housing. When the housing abuts the panel, or co-operating housing, it is held in position by the outer screws 42. The screen on the incoming cable is then terminated at the braid trap 12 to ensure a ground connection to the housing, and hence to the ground plane.

An insulative layer 44 may be provided on the inside of the housing 6 in the region of the PCB. This will prevent any of the terminating posts 22 from shorting to ground on the housing 6.

The use of the earthing springs 30 means that the surge arrestors can be used in the screened connector, without having to make a hard-wired connection between the ground plane and the housing. The springs 30 need not necessarily be of the same shape as those illustrated in FIG. 4, their primary purpose being to make electrical contact with the connector housing, preferably also to hold the PCB and ground plane together with the surge arrestors between them during assembly. The spring 32 could be angular rather than arcuate.

The protruding lugs need not be cut and bent from the middle wall 34, but could be abutments on the middle wall. In a further embodiment, the support spring could be used solely to connect the ground plane to the connector housing.

A screen electrical connector as described above is thus provided with surge arrestors to protect against surge voltages.

It will be appreciated, however, that the above description is intended to be exemplary and not limiting. The scope of the invention should, to the extent permitted by the prior art, be limited solely by the appended claims.

I claim:

1. A shielded electrical connector comprising a conductive connector housing to receive a shielded cable, means to connect the cable shield to the connector housing, a connector element located in the housing and having contacts connected to respective tracks on a printed circuit board within the housing, a ground plane spaced from the printed circuit board and electrically connected to the connector housing, and a plurality of surge arrestors located between respective tracks on the printed circuit board and the ground plane.

2. A connector according to claim 1 in which the surge arrestors have terminating posts at their respective ends which protrude through holes in the tracks on the printed circuit board.

3. A connector according to claim 2 wherein the housing is slidable over the assembly of the connector element, printed circuit board, ground plane and surge arrestors, after conductors of a cable have been connected to this assembly, and wherein a resiliently flexible member connected to the ground plane makes electrical contact with the housing as it is slid over the said assembly.

4. A connector according to claims 2 or 3, comprising a clip to urge the printed circuit board and the ground plane against the respective ends of the surge arrestors prior to soldering the terminating posts to the printed circuit board and the ground plane.

5. A connector according to claim 4, in which the clip contacts the ground plane and includes the resiliently flexible member making electrical contact with the connector housing.

6. A connector according to claim 4, in which the clip comprises a section of rectangular channel with two lugs protruding from the base of the channel near to the respective channel side walls each defining a groove with the respective side wall to receive a respective one of the printed circuit board and the ground plane.

7. A connector according to claims 1 in which the conductors of an incoming cable are soldered directly to the terminating posts of the surge arrestors.

8. A connector according to claim 1, in which the connector housing retains an elastomeric conductive seal around an end of the housing in which the connector element is located.

9. A shielded electrical connector comprising a conductive connector housing, a connector element, a printed circuit board within the housing and connected to the connector element, a ground plane spaced from the printed circuit board, and a resiliently flexible member located between the connector housing and the ground plane and making an electrical connection therebetween.

10. A shielded electrical connector according to claim 9, in which the resiliently flexible member comprises a second clip to attach the member to the ground plane, the resiliently flexible member also comprising a first clip to attach the member to the printed circuit board.

11. A shielded electrical connector according to claims 9 or 10, in which the resiliently flexible member is soldered to the ground plate.

12. A shielded electrical connector according to claim 10, in which the resiliently flexible member and the associated clips are constructed from the same piece of material.

* * * * *